US006507158B1

(12) United States Patent
Wang

(10) Patent No.: US 6,507,158 B1
(45) Date of Patent: Jan. 14, 2003

(54) PROTOCOL ENHANCEMENT FOR LIGHTING CONTROL NETWORKS AND COMMUNICATIONS INTERFACE FOR SAME

(75) Inventor: Shenghong Wang, Yorktown Heights, NY (US)

(73) Assignee: Koninkljke Philips Electronics N.V., Eindhoven (NL)

( * ) Notice: Subject to any disclaimer, the term of this patent is extended or adjusted under 35 U.S.C. 154(b) by 95 days.

(21) Appl. No.: 09/713,185

(22) Filed: Nov. 15, 2000

(51) Int. Cl.[7] ..... H05B 37/00
(52) U.S. Cl. ..... 315/294; 315/292
(58) Field of Search ..... 315/292–297, 315/291, 312, 316, 318, 320, 324; 340/825.06

(56) References Cited

U.S. PATENT DOCUMENTS 5,962,992 A * 10/1999 Huang et al. ..... 315/294
6,020,825 A 2/2000 Chansky et al. ..... 340/825.06
6,118,230 A * 9/2000 Fleischmann ..... 315/294

OTHER PUBLICATIONS

DALI Standard EN60929 Annex E.

* cited by examiner

*Primary Examiner*—Don Wong
*Assistant Examiner*—Wilson Lee

(57) ABSTRACT

An enhanced protocol for enabling manual control of electronic ballasts in lighting control networks which are compliant with the DALI standard, as well as a communications interface apparatus for such a ballast for decoding both the standard DALI messages, as well as the manual control messages available in the enhanced protocol of the present invention are presented.

25 Claims, 5 Drawing Sheets

| | |
|---|---|
| • F000H | CPCM_CON(7:0) |
| • F001H | CPCM_CLK(7:0) |
| • F002H | CPCM_ABX(7:0) |
| • F003H | CPCM_DCX(7:0) |
| • F004H | CPCM_BWX(7:0) |
| • F005H | CPCM_MOP(7:0) |
| • F006H | CPCM_DIA(7:0) |

FIG. 2

| 7 | 6 | 5 | 4 3 | 2 | 1 | 0 |
|---|---|---|---|---|---|---|
| MCU_NACK | MCU_MACK | MUP_EN | RESERVIED | TEST | MODE | SRESET |
| 2A07 | | | | 2A02 | 2A01 | |

FIG. 2A

| 7 | 6 | 5 | 4 | 3 2 | 1 0 |
|---|---|---|---|---|---|
| NIRQ | MIRQ | ERROR | R/T | PSTATE(1:0) | CSTATE(1:0) |
| 2B07 | 2B06 | 2B05 | 2B04 | 2B02 | 2B01 |

FIG. 2B

PROTOCOL ENHANCEMENT FOR LIGHTING CONTROL NETWORKS AND COMMUNICATIONS INTERFACE FOR SAME

TECHNICAL FIELD

This invention relates to an enhancement of the DALI protocol, additionally enabling the manual control of digital ballasts in a lighting control network, and a DALI compliant communications apparatus to interpret the enhanced protocol. The invention has particular application in a lighting control network compliant with the Digital Addressable Lighting Interface (DALI) standard.

BACKGROUND OF THE INVENTION

DALI—the Digital Addressable Lighting Interface

The DALI protocol is a method whereby electronic ballasts, controllers and sensors belonging to the system in a lighting network are controlled via digital signals. Each system component has its own device-specific address, and this makes it possible to implement individual device control from a central computer.

History of the DALI Protocol

Research work connected to the DALI project began midway through the 1990s. However, the development of commercial applications got underway a little later, in the summer of 1998. At that time, DALI went under the name DBI (Digital Ballast Interface). An interface device (or ballast) is an electronic inductor enabling control of fluorescent lamps. The DALI standard has been the subject of R&D by numerous European ballast manufacturers such as Helvar, Hüco, Philips, Osram, Tridonic, Trilux and Vossloh-Schwabe. The DALI standard is understood to have been added to the European electronic ballast standard "EN60929 Annex E", and was first described in a draft amendment to International Electrotechnical Commission 929 ("IEC929") entitled "Control by Digital Signals." DALI is thus well known to those skilled in the art. Due to this standardization, different manufacturers' products can be interconnected provided that the manufacturers adhere to the DALI standard. The standard embodies individual ballast addressability, i.e. ballasts can be controlled individually when necessary. To date, ballasts connected to an analog 1–10 V DC low-voltage control bus have been subject to simultaneous control. Another advantage enabled by the DALI standard is the communication of the status of ballasts back to the lighting network's central control unit. This is especially useful in extensive installations where the light fixtures are widely distributed. The execution of commands compliant with the DALI standard and obtaining the status data presupposes intelligence on part of the ballast. This is generally provided by mounting a microprocessor within a DALI compliant ballast; the microprocessor also carries out other control tasks. Alternatively, two microprocessors can be utilized; one to interpret and service the DALI communications, and the other to provide the lamp control and diagnostics. The first products based upon the DALI technology became commercially available at the end of 1999.

Digital Control

The word 'digital' is a term which has become familiar to us all in the course of this decade in connection with the control technology built into domestic appliances as well as into industrial processes. Now, digital control is becoming increasingly common in the lighting industry as a result of the new DALI standard.

DALI Message Structure

DALI messages comply with the Bi-Phase, or Manchester, coding scheme, in which the bit values '1' and '0' are each presented as two different voltage levels so that the change-over from the logic level 'LOW' to 'HIGH' (i.e., a rising pulse) corresponds to bit value '1', and the change-over from the logic level 'HIGH' to 'LOW' (i.e., a falling pulse) corresponds to the bit value '0'. The coding scheme includes error detection and enables power supply to the control units even when there are no messages being transmitted or when the same bit value is repeated several times in succession. The bus's forward frame (used in communications from the central control unit to the local ballast) is comprised of 1 START bit, 8 address bits, 8 data/command bits, and 2 STOP bits, for a total of 19 bits. The backward frame (from the local ballast back to the central control unit) is comprised of 1 START bit, 8 data bits and 2 STOP bits, for a total of 11 bits. The specified baud rate is 2400.

DALI messages consist of an address part and a command part. The address part determines which DALI module the message is intended for. All the modules execute commands with 'broadcast' addresses. Sixty-four unique addresses are available plus sixteen group addresses. A particular module can belong to more than one group at one time.

The light level is defined in DALI messages using an 8-bit number, resulting in 128 total lighting levels. The value '0' (zero), i.e., binary 0000 0000, means that the lamp is not lit. The remaining 127 levels correspond to the various dimming levels available. The DALI standard determines the light levels so that they comply with the logarithmic regulation curve in which case the human eye observes that the light changes in a linear fashion. All DALI ballasts and controllers adhere to the same logarithmic curve irrespective of their absolute minimum level. The DALI standard determines the light levels over a range of 0.1% to 100%. Level 1 in the DALI standard, i.e., binary 0000 0001, corresponds to a light level of 0.1%.

Typical DALI Messages

Go to light level xx.

Go to minimum level.

Set value xx as regulation speed.

Go to level compliant with situation xx.

Turn lamp off.

Query: What light level are you on?

Query: What is your status?

From Analog To Digital

The idea concerning the DALI protocol emerged when the leading manufacturers of ballasts for fluorescent lamps collaborated in the development of a protocol with the leading principle of bringing the advantages of digital control to be within the reach of as many users as possible. Furthermore, the purpose was to support the idea of 'open architecture' so that any manufacturer's devices could be interconnected in a system.

In addition to control, the digital protocol enables feedback information to be obtained from the lighting fixture as to its adjustment level and the condition of the lamp and its ballast.

Examples of typical applications for systems using the DALI protocol are office and conference facilities, classrooms and facilities requiring flexibility in lighting adjustment. The lighting-control segment based on the DALI technology consists of maximum 64 individual addresses which are interconnected by a paired cable. DALI technology enables cost-effective implementation of lighting control of both smart individual lighting fixtures as well as of numerous segments connected to the automation bus of a building.

Because the DALI standard assumes that the local electronic ballast will be continually under the control of the central computer controlling the network or the series of networks (recall that under the DALI standard 64 unique addresses are available, but by setting one or more of these unique addresses to be assigned to another network chaining of networks can result and numerous individual luminaries can be controlled) there is no facility in DALI for temporarily taking a particular ballast "off line" and subjecting it to purely manual control, and then setting it back "on line." As a result, under the current state of the art, in order to allow for the manual control of a local electronic ballast by the occupant of the room or office in which that ballast exists, some additional circuitry or wiring would be required to somehow cause the manual suspension of commands coming from the lighting network for an interval of time. Such additional circuitry or wiring would be in addition to the existing circuitry in the electronic ballast increasing the cost of the ballast and its complexity. Alternatively, additional circuitry and wiring could be provided to control the ballast by DC control or by a pulse width modulation, but this option would also increase the cost and complexity. What is desired is a protocol which would enhance the DALI standard, and would be easily decodable by DALI compliant ballasts without the addition of additional circuitry or pins, or a change in the signal type (such as to DC or pulse modulated) so as to allow for the suspension of the network commands for an interval of time to afford the human occupant of the room or space in the building in which the electronic ballast and the luminary is located to manually set the dimming level or turn off the lamp.

Additionally, the current state of the art provides the intelligence to the ballast required by the DALI standard by means of a microprocessor. However, the lamp control and diagnosis in an electronic ballast also must be controlled by a microprocessor. As described above, for maximum availability of the microcontroller to handle lamp control and diagnostics, two microprocessors per ballast are required. Alternatively, one microprocessor could be used, and it would have to service both the DALI communications traffic as well as control the lamp. This latter solution is more efficient, at the price of an additional microprocessor. What would be truly desirable is a separate ASIC dedicated to handle the DALI communications and messaging.

SUMMARY OF THE INVENTION

The above-described problems of the prior art are overcome in accordance with the teachings of the present invention which relates to an enhanced protocol for enabling manual control of electronic ballasts in lighting control networks which are compliant with the DALI standard, as well as the design of a communications apparatus for decoding both standard DALI messages, as well as local manual control messages. As described below, the signaling is arranged such that certain signal lengths below a predetermined threshold are interpreted as DALI commands, and lengths above a threshold are interpreted as manual overrides. Moreover, the control information in the manual override signal is also conveyed by measuring the length of such signal. In a preferred embodiment the lamp is controlled by a microcontroller, and the DALI commands are interpreted by a specialized processor.

BRIEF DESCRIPTION OF THE DRAWINGS

FIG. 2 depicts in more detail the registers shown in the apparatus of FIG. 1;

FIG. 2A depicts an expanded view of the Cpcm_con register;

FIG. 2B depicts an expanded view of the Cpcm_dia register;

DETAILED DESCRIPTION OF THE PREFERRED EMBODIMENT

The DALI Communications Interface

The structure and operation of the Communication Port Control Module (CPCM) will now be described with reference to FIGS. 1–5. The CPCM is a communications interface ASIC located on the ballast, which can transmit and receive signals with the central network, a local manual control interface, and the microcontroller which drives the lamp. The use of an ASIC to provide the DALI required intelligence to handle the network/lballast—as well as the manual interface/ballast as per the present invention—communications, provides the efficiency of an extra microprocessor at a fraction of the cost.

Figure 1:
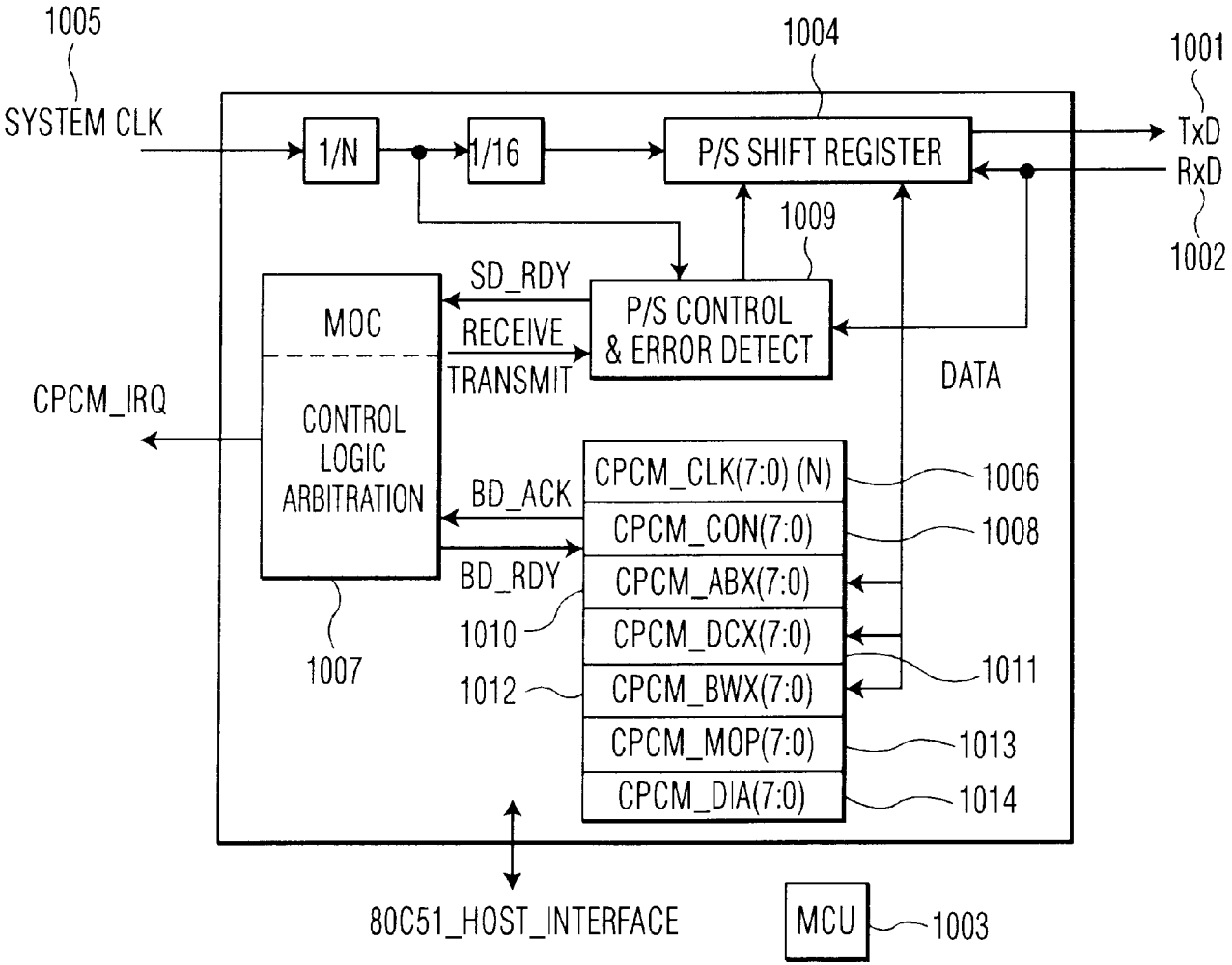
FIG. 1 depicts an exemplary embodiment of the present invention's communications interface apparatus.

The CPCM of the preferred embodiment of the present invention will now be described with reference to FIG. 1, focusing on the handling of standard DALI network signals.

After the power is turned on to the CPCM, or after a reset occurs, the CPCM is in a receive state and it waits for a start bit indicating a DALI communication. The CPCM detects the start bit and checks the bi-phase level signals. As described above, the DALI standard prescribes that most of the signals used in the DALI communications protocol be bi-phase. If the data format is wrong or if there is any error in receiving the data, the CPCM will ignore the data and start to receive new data. This activity is performed by the parallel/serial control and error detection module 1009. If the data received is correct, the data will be transferred to registers cpcm_abx 1010 and cpcm_dcx 1011. At this time an interrupt signal, data_ready, will go high and the CPCM will stop receiving new data until the microcontroller 1003 sends an acknowledge signal. This acknowledgement is stored as one of the bits in the cpcm_con register, mcu_nack, as seen in FIG. 2A in the $7^{th}$ bit position, or MSB. When this most significant bit of cpcm_con goes high, i.e., has a logical value of "1", the microcontroller 1003 is acknowledging receipt of the data. When the microcontroller 1003 receves the data ready signal (for simplicity the signal path of this signal is not shown in FIG. 1 but is subsumed in the parallel interface between the CPCM and the microcontroler 1003), it reads the data from registers cpcm_abx 1010 and cpcm_dcx 1011 (FIG. 1). Depending on the command received, the CPCM may be asked to send data back to the network or to continue to receive new data from the network. Obviously, the network signals enter the CPCM via the R×D pin 1002. If the CPCM is required to send data back to the network, the microcontroller 1003 will write this data to the cpcm_bwx register 1012 first, then set the "1" bit of the cpcm_con register "MODE",2A01 in FIG. 2A, high, or equal to logical "1", which indicates transmit state, and the cpcm_con "7" bit, 2A07 in FIG. 2A, also at a logical "1" or high. Cpcm_con (7) 2A01 is the acknowledge data ready signaling bit. The CPCM would then transmit the data requested by the network to the network by sending the contents of cpcm_bwx 1012 (FIG. 1) out along the T×D pin 1001 to the network. Once the CPCM has finished its data transmission, the data_ready signal is once again set high and the CPCM waits for the microcontroller 1003 to acknowledge. If more data is required to be sent the microcontroller 1003 will again write new data to cpcm_bwx 1012 and set cpcm_con(7) 2A07 (FIG. 2) high again. If no more data is required to be sent, the microcontroller 1003 will set cpcm_con(1) 2A01 (FIG. 2) low and cpcm_con(7) 2A07 will be set high. The CPCM will then return to the receive state allowing it to receive instructions once again from the network. If the cpcm_con(2) test bit, shown as 2A02 in FIG. 2A, is set high, the CPCM is forced into a transition state and cannot receive further instructions from the network.

A full description of the CPCM function registers is as follows, with reference to FIG. 1. The cpcm_clk 1006 register is the communication data rate control register. It calculates the transmit/receive data rate by means of the following formula: the data frequency is equal to the system frequency divided by [32 times (N+1)], where N is the integer value of the cpcm_con(6:4) bits added to cpcm_clk (7:0). The cpcm_abx register 1010 is a read only address register. The cpcm_dcx register 1011 is a read only data register. The cpcm_bwx 1012 is the backward register, which is written to by the microcontroller 1003 when data has been requested to be sent back to the network, as described above. The cpcm_mop register 1013 is the manual operation dimming data register. It stores the 8 bit dimming level manually communicated to the CPCM, as described below concerning the enhanced protocol, in the manual operation mode. Finally, the cpcm_dia register 1014 is a diagnostic register, each of which's bits have a separate function, as shown in FIG. 2B. The seventh bit, or most significant bit, is the NIRQ bit 2B07, which is the network control interrupt flag. The sixth bit is the MIRQ bit 2B06 which is the manual control interrupt flag. The fifth bit is the ERROR bit 2B05 which is a receiving error flag. The receiving error flag is set to 1 if there is an error and 0 if there is no error. The fourth bit 2B04 is the receiving or transmitting bit which is coded as follows: the fourth bit is set to a 1 to designate a receiving state or to a 0 to designate a transmission state. Bits 3:2 are the PSTATE bits 2B02; together they store the CPCM port state. Bits 1:0 are the CSTATE bits 2B01, and together they store the CPCM control statement.

FIG. 2 depicts the addressing of the CPCM registers, where all have 8 bit addresses. FIG. 2A discloses the individual bit assignments in the 8 bit Cpcm_con register, which is used for status signaling. The 0 bit is used for software reset, and the 1 bit for indication of the CPCM's communication mode status vis-à-vis the network, where "1" indicates transmission mode and "0" indicates receiving mode. Bit 3 is used to set the CPCM into the transmission state for testing purposes, and bit 4 is reserved. Bits 5–7 are used for flagging whether the microcontroller is under network control or manual control, which in the latter case would utilize the enhanced protocol of the present invention. Bit 7 acknowledges that the microcontroller is under network control, bit 6 acknowledges that the microcontroller is under manual control, and bit 5 is used to enable or disable manual control, by interpreting the various voltage signals received, as described below. Obviously, bits 6 and 7 will always have opposite values, and bits 5 and 6 will generally have the same value, except for the interval between manual control being instructed by signal to the CPCM and its implementation being acknowledged by the microcontroller.

Figure 3:
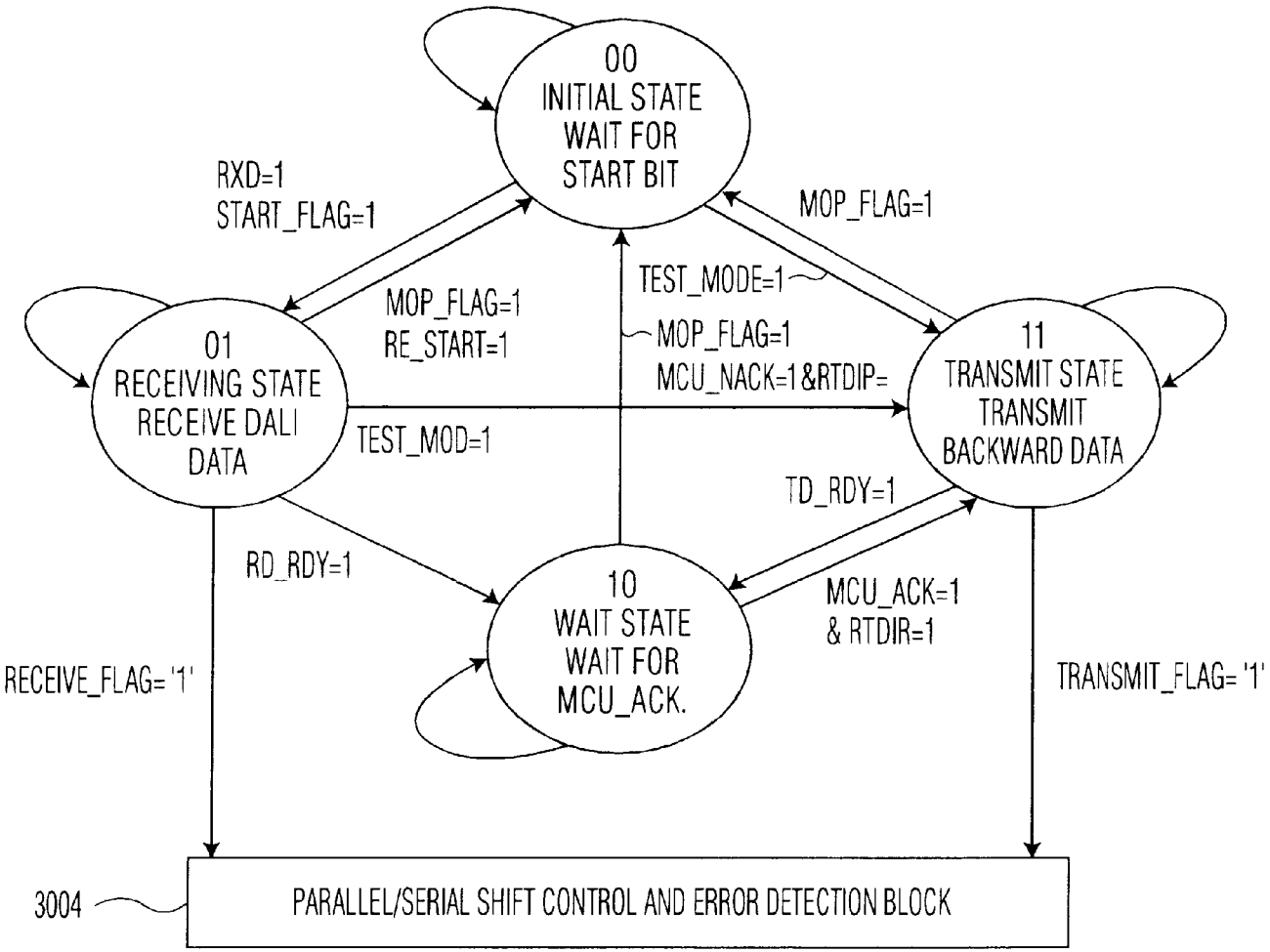
FIG. 3 depicts an exemplary state diagram of the control logic for the communications interface apparatus.
Figure 4:
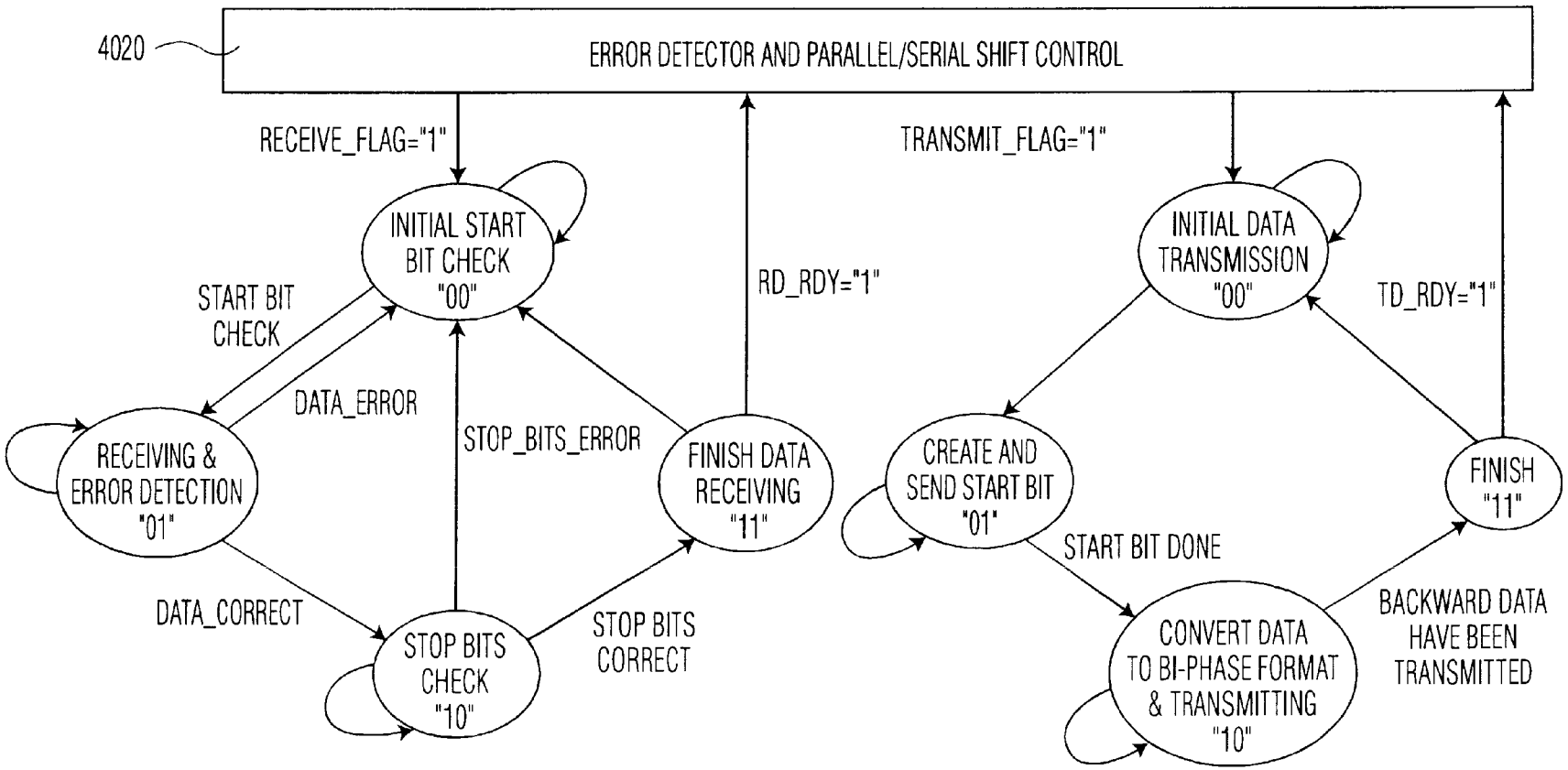
FIG. 4 depicts an exemplary state diagram of the error detector and parallel/serial shift control of the communications interface apparatus.

FIGS. 3 is a state diagram of the control logic arbitration block of the MOC/Control Logic Arbitration module 1007 (FIG. 1) of the CPCM indicating how the transmit and receive flags are set in the P/S control and error detection module 3004. FIG. 4 is a state diagram of the P/S control and error detection module showing the interaction with the control logic module 4020. FIGS. 3 and 4 depict operation in network mode, where regular DALI protocl compliant signals are used.

Figure 5:
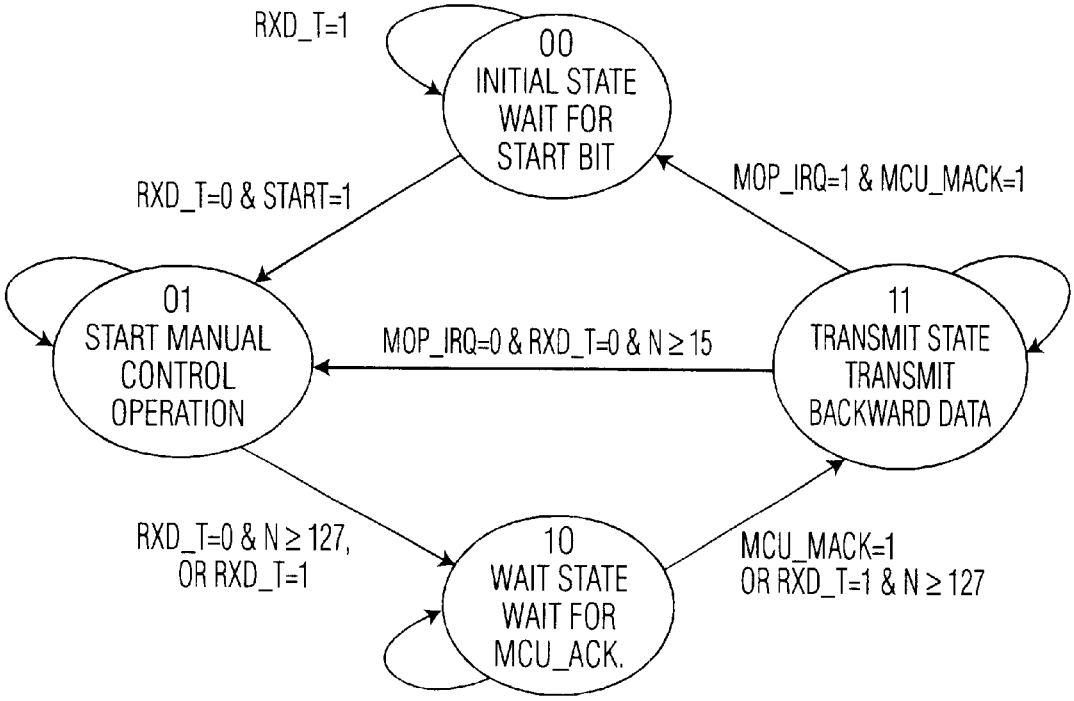
FIG. 5 depicts an exemplary state diagram of the manual operations control block.

However, the CPCM also interprets the manual override signals of the enhanced protoodi of this invention as described below. This activity utilizes the MOC submodule of the MOC/Control Logic Arbitration module 1007 (FIG. 1). FIG. 5 is thus a state diagram of the manual operational control block (MOC) of the MOC/Control Logic Arbitration module 1007 (FIG. 1). FIG. 5 indicates how the CPCM handles the enhanced DALI protocol for manual control of lighting networks of this invention, as described below.

The state diagrams depicted in FIGS. 3–5 trace the data flow as well.

Manual Control—The Enhanced Protocol

Figure 6:
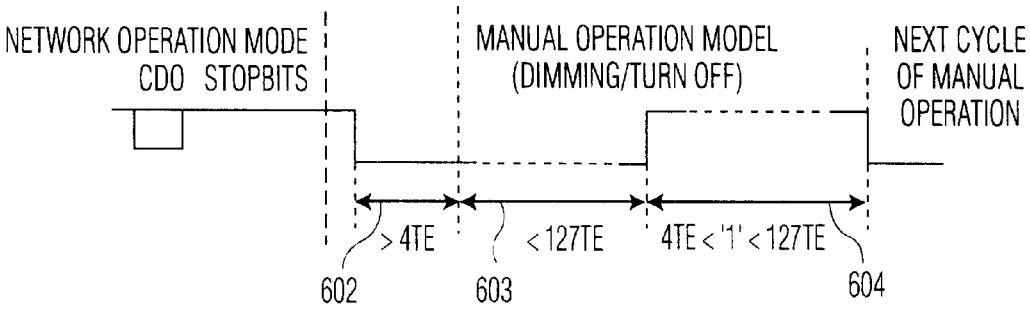
FIG. 6 depicts an exemplary timing diagram for the enhanced protocol of the present invention.

The precise working of the protocol for manual operation will now be described with reference to FIG. 6. FIG. 6 depicts the voltage signals as seen on the R×D pin of the CPCM 1002 as shown in FIG. 1. Manual operation refers to overriding the computer control of the lighting device with control signals from, for example, a manual wall dimmer switch. As can be seen in FIG. 6, the signaling related to the manual mode is concerned with three separate time intervals. These intervals are labeled as 602, 603 and 604, and their significance will be next explained. As is well known in the art, the DALI standard protocol provides that when there is no network-ballast communications the bus voltage is held high. This refers not to a continual rising peak as in Manchester or bi-phase coding, but simply to holding the bus constant at the high voltage level. Taking advantage of this fact, the preferred embodiment of the invention specifies that to switch the CPCM, and thus the electronic ballast control, from network operation mode to manual operation mode (i.e., local manual control of the ballast and the lamp connected to, and controlled by, it), the R×D pin 1002 (FIG. 1) receives a low signal for a time interval which is greater than 4Te 602, where Te is one half the bit length (in terms of time) as defined in the DALI protocol. Actually, this value is somewhat arbitrary, designed to be greater than the 2Te interval in DALI for which a low signal could exist (i.e., a bi-phase "0" followed by a bi-phase "1") with a safety margin. The length could thus be set at a variety of values depending on the desired safety margin and noise concerns. Thus, once the CPCM sees the low signal on the R×D pin for longer than 4Te, the operational mode is shifted, and the CPCM begins measuring the duration of the low signal to calculate the length of the interval 603. At this point the ballast is under manual control, and the length of the interval 603 determines the dimming level of the lamp. This manualdata signal 603 is a constant low level, or logical "0" voltage of variable length, and can be up to, but not including, 127Te. As noted, this data signal sets the dimming level of the lamp due to the fact that the CPCM counts the intervals Te that the signal is held at logical "0", and interprets each as a dimming level from 0 to 126, which is then stored in the manual operation dimming data register cpcm_mop 1013 (FIG. 1) and communicated to the microcontroller 1003 (FIG. 1) to dim the lamp accordingly. If the signal is a constant logical "0" for longer than 127Te, this is an extreme condition, and can be set by the system designer to be interpreted as a turn-off signal, a turn on signal, or any other useful lamp condition choice. This is because in an 8 bit data word system, which is what the DALI standard provides, and thus that is what the CPCM is designed to use (although once in manual mode a different data word could be used as well), if time interval 603 exceeds 127Te there is an overflow conditon; it can be thus set as per the system designer's choice; for simplicity it will be herein assumed to be set as a turn-off condition. In the event of either of a manual dimming instruction or such a manual turn-off instruction, the lamp will remain in such a state, and no further changes can be made to the lamp until the R×D input signal 1002 (FIG. 1) to the CPCM is held at the high voltage level, i.e., a logical "1", for a time interval 604. To be considered, this time interval 604 must exceed 4Te (or some other reasonable time interval). If it is less than 4Te there is no change to the lamp, as no instruction is recognized. Thus, if the signal is a pulse with the period and duty cycle such that the high interval is always less than 4Te, nothing further will happen. If it is desired to send further input to the CPCM, via either another manual instruction or to simply put the CPCM back into the network control mode, the R×D signal is held high for an interval greater than 4Te. If it is held high for a time interval 604 greater than 4Te but less than 127Te the CPCM will remain in manual mode, and begin another dimming/shut-off manual instruction cycle by measuring the time interval 603 (now following the interval 604) that R×D is held low. If the interval 604 exceeds 127Te (again, in an 8 bit system, the obvious overflow point) then the CPCM is put back into network control mode. Additionally, if the lamp has been turned off (or otherwise set to the extreme condition definition state) in interval 603, then an interval 604 greater than 127Te can operate to turn on the light (or some other system definable state) as well.

From the foregoing it is obvious, that in the preferred embodiment of the invention, if it is desired to keep the CPCM in the manual operational mode and keep the lamp at a specific manually set dimming or turn off setting for an extended time period, the R×D input 1002 (FIG. 1) of the CPCM will need to be prevented from being held high for a time interval greater than 127Te because a "high" for a time interval greater than 127Te results in a reset out of manual mode. Simply alternating the signal in region 604 such that it never remains high for more than 4Te will accomplish this task. When it is desired to place the system backinto network mode, the signal is simply pulled high for a time exceeding 127Te. Alternatively, if it is desired to place the system into another manual operation mode, the signal is simply pulled high for a time interval greater than 4Te. These considerations, as well as the design of a manual interface to the CPCM to generate the desired local manual operation signals, require only basic engineering techniques and may be accomplished by an ordinarily skilled artisan.

While the foregoing describes the preferred embodiment of the invention, it is understood by those of skill in the art that various modifications and variations may be utilized. Such modifications are intended to be covered by the following claims.

What is claimed:

1. A method of controlling a lighting device, said method comprising:

transmitting signals from a first source to said lighting device;

transmitting signals from a second source to said lighting device; and determining whether signals received by said lighting device is from said first source or said second source based upon a length of each signal, and controlling an operation of the lighting device in accordance with such signals.

2. The method of claim 1, wherein the first source and the second source include a computerized source and a manual override source, respectively.

3. The method of claim 2, wherein said determining includes determining that a signal is from said manual override source if said signal remains substantially at a predetermined level for longer than a predetermined time period.

4. The method of claim 3, wherein if said signal remains at substantially said predetermined level for longer than said predetermined time period, then a length of time over said predetermined time period for which said signal remains substantially at said predetermined level is measured, and said length of time over said predetermined time period indicates information regarding how to operate said lighting device.

5. The method of claim 4, wherein said length over said predetermined time period is followed by alternating logical highs and logical lows; and wherein a duration of said logical highs is set to be below a predetermined length.

6. A lighting device, comprising:

an interface for receiving control signals from a controller to operate said device, and for receiving manual override signals to operate said device;

means for determining whether a received signal is a control signal or a manual override signal based upon the length thereof; and means for controlling the lighting device based upon said received signal.

7. The lighting device of claim 6, further comprising:

a processor for interpreting the length of said received signal to ascertain information regarding lighting intensity at which to illuminate said lighting device.

8. The lighting device of claim 7, wherein said processor interprets the length of time for which said received signal is held low to correspond to an intensity at which to illuminate said lighting device.

9. The lighting device of claim 7, wherein said processor determines that signals held low for longer than a predetermined time are manual override signals, and signals held low for less than said predetermined time are not manual override signals.

10. A signal generator for controlling a lighting device from either a manual override signal or a network signal, the signal generator comprising:

means for holding a logical signal low for at least a predetermined time period in order to indicate that said lighting device should be controlled by said manual override signal; and means for causing said logical signal to be held low for no greater than said predetermined time when said lighting device is to be controlled by said network signal.

11. The signal generator of claim 10, wherein after said logical signal is held low for the predetermined time period, said logical signal is held low for an amount of time indicative of the intensity at which said lighting device should be operated.

12. The signal generator of claim 11, wherein after said logical signal is held low for an amount of time indicative of the intensity at which said lighting device should be operated, said logical signal is held high for an amount of time indicative of whether said lighting device should be controlled subsequently by said manual override signal or said network signal.

13. A protocol for communicating with a local interface, where said local interface is connected to each of (a) a central server from which it receives signals, (b) a local signal generating device from which it receives signals, and (c) a local lamp controller which receives input signals from the local interface and outputs control signals to a lamp, and where said local interface is arranged to receive said signals from the central server when in a first communication mode and is arranged to receive said signals from the local signal generating device when in a second communication mode, said protocol comprising:

a beginning elapsed time threshold;

an interim elapsed time interval;

a resetting elapsed time threshold;

a terminating elapsed time threshold;

wherein said protocol is arranged such that a signal of a first type sent from the local signal generator for a time greater than the beginning elapsed time threshold will cause the local interface to change from the first communication mode to the second communication mode;

wherein said protocol is further arranged so that while the local interface is in the second communication mode:

a signal of the first type sent from the local signal generator for a dimming time greater than zero but less than the interim elapsed time interval will cause the local interface to signal the lamp controller to dim the lamp by an amount that is proportional to, or inversely proportional to, the dimming time, and a signal of the first type sent from the local signal generator for a dimming time greater than the interim elapsed time interval will cause the local interface to implement a definable lamp condition; and wherein said protocol is further arranged so that while the local interface is in the manual mode:

a signal of the second type sent from the local signal generator for a time greater than the resetting elapsed time threshold but less than the terminating elapsed time threshold will cause the local interface to enter another cycle in the second communication mode, and a signal of the second type sent from the local signal generator for a time greater than the terminating elapsed time threshold will cause the local interface to change to the first communication mode, and will cause the local interface to implement a definable lamp condition.

14. The protocol of claim 13, wherein the local interface is in communication with a ballast which controls the lamp.

15. The protocol of claim 14, wherein the local interface and the central server are part of a lighting control network.

16. The protocol of claim 14, wherein the first communication mode includes communications from the lighting network central server to the local interface, the second communications mode includes communications of manually generated signals, and the local signal generator is a manual interface to the ballast.

17. A protocol for communicating with a local interface, where said local interface is connected to each of (a) a central server from which it receives signals, (b) another signal generating device, and (c) a controller which controls a light, and where said local interface is arranged to receive signals from the central server when in a first communication mode and is arranged to receive signals from the other signal generating device when in a second communication mode, and is arranged to receive no signals when in a dormant mode, said protocol comprising:

a beginning elapsed time threshold;

an interim elapsed time interval;

a resetting elapsed time threshold;

a terminating elapsed time threshold;

wherein said protocol is arranged such that a signal of a first type sent from the other signal generator for a time greater than the beginning elapsed time threshold will cause the local interface to change from the first communication mode to the second communication mode;

wherein said protocol is further arranged so that while the local interface is in the second communication mode:

a signal of the first type sent from the other signal generator for a dimming time greater than zero but less than the interim elapsed time interval will cause the local interface to signal the controller to dim the light by an amount that is proportional to, or inversely proportional to, the dimming time, and will cause the local interface to enter the dormant mode, and a signal of the first type sent from the other signal generator for a dimming time greater than the interim elapsed time interval will cause the local interface to implement a definable lamp condition, and will further cause the local interface to enter the dormant mode; and wherein said protocol is arranged so that while the local interface is in the dormant mode:

a signal of the first type sent from the other signal generator for a time greater than the resetting elapsed time threshold but less than the terminating elapsed time threshold will cause the local interface to change to the second communication mode, and a signal of the second type sent from the other signal generator for a time greater than the terminating elapsed time threshold will cause the local interface to change from the dormant mode to the first communication mode, and will cause the local interface to implement a definable lamp condition.

18. The protocol of claim 17, wherein the local interface is part of, and communicably connected to, a ballast which controls an electric lamp.

19. The protocol of claim 18, wherein the local interface and central server are part of a lighting control network.

20. The protocol of claim 18, wherein the first communication mode includes communications from the lighting network central server to the local interface, the second communications mode includes communications of manually generated signals, and the other signal generator is a manual interface to the ballast.

21. A communications interface in communication with the controller of a ballast, where said communications interface is capable of communicating with a network server, said communications interface comprising:

a controller; and a plurality of storage elements, wherein said controller is operable to interpret generated by a protocol including
a beginning elapsed time threshold,
an interim elapsed time interval,
a resetting elapsed time threshold, and
a terminating elapsed time threshold, wherein the protocol is arranged such that a signal of a first type sent from a local signal generator for a time greater than the beginning elapsed time threshold will cause a local interface to change from a first communication mode to a second communication mode.

22. The communication interface of claim 21, wherein said protocol is further arranged so that while the local interface is in the second communication mode:

a signal of the first type sent from the local signal generator for a dimming time greater than zero but less than the interim elapsed time interval will cause the local interface to signal a lamp controller to dim the lamp by an amount that is proportional to, or inversely proportional to, the dimming time, and a signal of the first type sent from the local signal generator for a dimming time greater than the interim elapsed time interval will cause the local interface to implement a definable lamp condition.

23. The communication interface of claim 21, wherein said protocol is further arranged so that while the local interface is in the manual mode:

a signal of the second type sent from the local signal generator for a time greater than the resetting elapsed time threshold but less than the terminating elapsed time threshold will cause the local interface to enter another cycle in the second communication mode, and a signal of the second type sent from the local signal generator for a time greater than the terminating elapsed time threshold will cause the local interface to change to the first communication mode, and will cause the local interface to implement a definable lamp condition.

24. The communication interface of claim 21, wherein said protocol is further arranged so that while the local interface is in the second communication mode:

a signal of the first type sent from the local signal generator for a dimming time greater than zero but less than the interim elapsed time interval will cause the local interface to signal a controller to dim the light by an amount that is proportional to, or inversely proportional to, the dimming time, and will cause the local interface to enter the dormant mode, and a signal of the first type sent from the local signal generator for a dimming time greater than the interim elapsed time interval will cause the local interface to implement a definable lamp condition, and will further cause the local interface to enter the dormant mode.

25. The communication interface of claim 21, wherein said protocol is arranged so that while the local interface is in a dormant mode:

a signal of the first type sent from the local signal generator for a time greater than the resetting elapsed time threshold but less than the terminating elapsed time threshold will cause the local interface to change to the second communication mode, and a signal of the second type sent from the local signal generator for a time greater than the terminating elapsed time threshold will cause the local interface to change from the dormant mode to the first communication mode, and will cause the local interface to implement a definable lamp condition.

* * * * *